US006755754B2

(12) United States Patent
Kato et al.

(10) Patent No.: US 6,755,754 B2
(45) Date of Patent: Jun. 29, 2004

(54) GOLF BALL

(75) Inventors: Akira Kato, Kobe (JP); Takashi Sasaki, Kobe (JP); Satoshi Iwami, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/041,496

(22) Filed: Jan. 10, 2002

(65) Prior Publication Data

US 2002/0155903 A1 Oct. 24, 2002

(30) Foreign Application Priority Data

Feb. 19, 2001 (JP) ..... 2001-041866

(51) Int. Cl.[7] ..... A63B 37/06
(52) U.S. Cl. ..... 473/374
(58) Field of Search ..... 473/351, 367, 473/368, 370, 371, 374, 376, 378

(56) References Cited

U.S. PATENT DOCUMENTS

| | | | | | |
|---|---|---|---|---|---|
| 4,714,253 | A | * | 12/1987 | Nakahara et al. | 473/373 |
| 4,884,814 | A | | 12/1989 | Sullivan | |
| 5,002,281 | A | * | 3/1991 | Nakahara et al. | 473/373 |
| 5,072,944 | A | * | 12/1991 | Nakahara et al. | 473/373 |
| 5,184,828 | A | * | 2/1993 | Kim et al. | 473/374 |
| 5,553,852 | A | | 9/1996 | Higuchi et al. | |
| 5,899,822 | A | | 5/1999 | Yamagishi et al. | |
| 5,935,022 | A | * | 8/1999 | Sugimoto et al. | 473/373 |
| 6,248,029 | B1 | | 6/2001 | Maruko | |
| 6,315,682 | B1 | * | 11/2001 | Iwami et al. | 473/374 |
| 6,390,936 | B1 | * | 5/2002 | Sugimoto | 473/374 |

FOREIGN PATENT DOCUMENTS

| | | | | |
|---|---|---|---|---|
| GB | 2 264 302 A | | 8/1993 | |
| GB | 2 311 530 A | | 10/1997 | |
| JP | A10-179802 | | 7/1998 | |
| JP | 2000-084118 | * | 3/2000 | A63B/37/00 |

* cited by examiner

*Primary Examiner*—Raeann Gorden
(74) *Attorney, Agent, or Firm*—Birch, Stewart, Kolasch & Birch, LLP

(57) ABSTRACT

To provide superior hit feel, a high coefficient of restitution, superior spin characteristics (controllability) and in addition thereto superior abrasion resistance when it is hit with an iron club, a golf gall includes a center core, an intermediate layer and a cover, wherein: the center core has a diameter of 25 to 40 mm, and a surface hardness (B) and a center hardness (A), the surface hardness (B) being at least 15 greater than the center hardness (A), as measured in Shore D hardness; the intermediate layer has a surface hardness (C) 20 to 50 greater than the center hardness (A) of the center core, as measured in Shore D hardness; the cover has a hardness (D) of 40 to 60, as measured in Shore D hardness; and the surface hardness (C) of the intermediate layer is 5 to 25 greater than the hardness (D) of said cover, as measured in Shore D hardness.

20 Claims, 1 Drawing Sheet

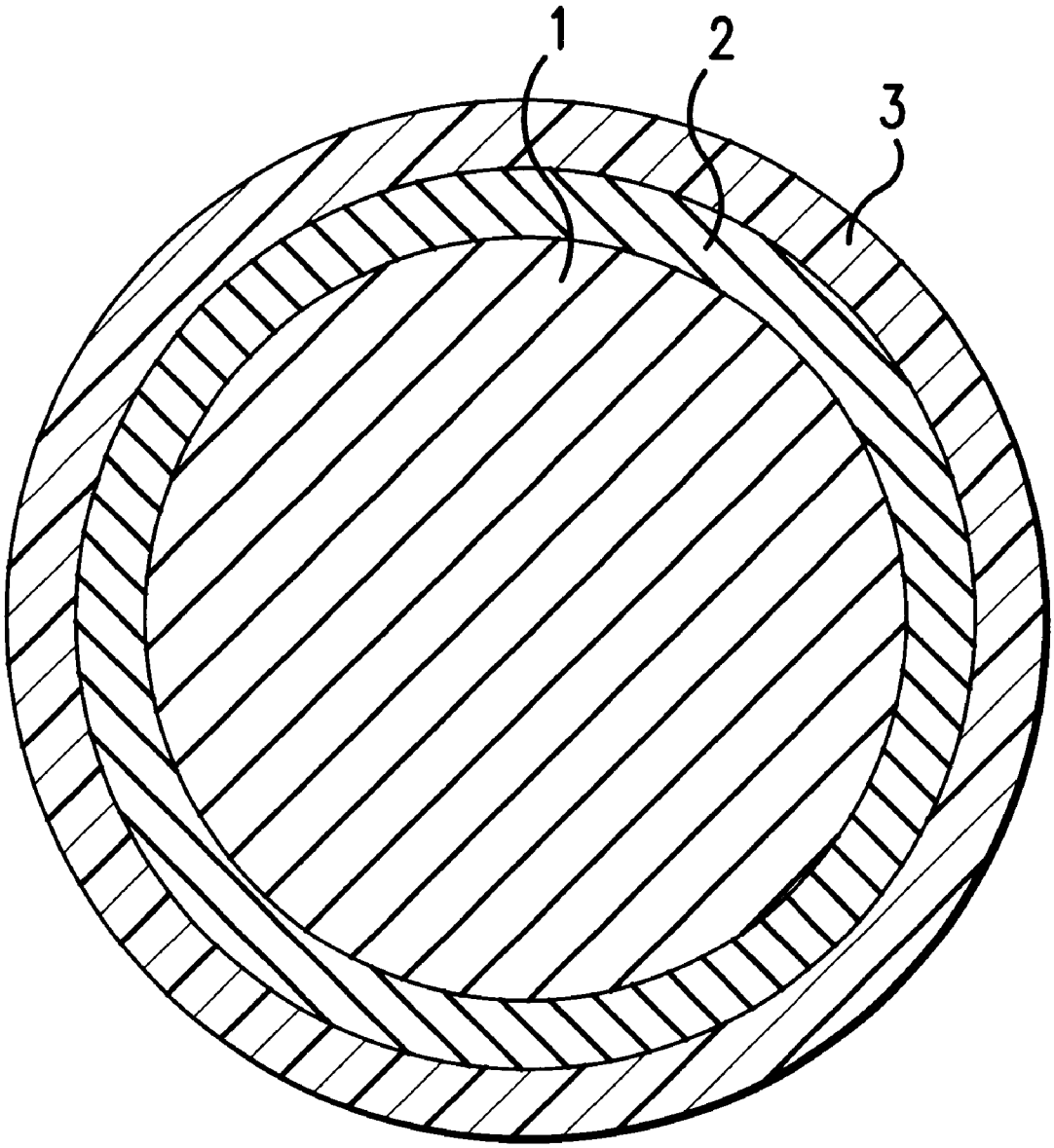
1
2
3

GOLF BALL

BACKGROUND OF THE INVENTION

1. Field of the Invention

The present invention relates to a golf ball providing superior hit feel, large ball flight distances (impact resilience), superior spin characteristics (controllability), and superior abrasion resistance.

2. Description of the Related Art

Golf balls providing large ball flight distances and high spinning performance in approach shots have been proposed to have a center core of soft rubber, an intermediate layer overlying and covering the core and formed of relatively hard rubber, and a cover thereon formed of soft material to allow the golf balls to have a dual-layer core or a dual-layer cover structure.

For example, U.S. Pat. No. 5,553,852 discloses a golf ball having a center core of having a diameter of no less than 29 mm, and an intermediate layer having a JIS-C hardness of no less than 85, with the center core greater in specific gravity than the intermediate layer. The intermediate layer, however, is formed of ionomer and the golf ball thus provides a small coefficient of restitution and thus cannot provide large ball flight distances.

U.S. Pat. No. 5,899,822 discloses a golf ball having a solid core with a deformability of no less than 2.5 mm for a load of 100 kg, and an intermediate layer harder than the cover by a Shore-D of no less than 13, with a moment of inertia of no less than 83 g $cm^2$. The cover, however, is formed of urethane resin and the golf ball thus provides a small coefficient of restitution and thus cannot provide large ball flight distances.

Furthermore, U.S. Pat. No. 6,248,029 discloses a multi-piece golf ball having a solid core formed of inner and outer cores, and an intermediate layer outer than the solid core, wherein the solid core and the intermediate layer is formed of a rubber composite containing polybutadiene as a main component and the inner core has a diameter of 15 to 22 mm and a Shore-D hardness of 40 to 70. However, the diameter of the inner core is too small and the golf ball thus provides a small coefficient of restitution and it also has a large spin rate at impact and thus cannot provide large ball flight distances when it is hit with a driver.

Using various types of soft material for covers has also been proposed. For example, U.S. Pat. No. 4,884,814 discloses using soft ionomer resin to form a cover. More specifically, ethylene-(meth)acryl acid-(meth)acrylate ester terpolymer, a relatively soft ionomer resin, blended with ionomer resin of ethylene-(meth)acryl acid copolymer of a physical property extent to an extent is used to provide a cover of a blend of soft and hard ionomers. This technique improves the inferior hit feel and poor controllability of conventional golf balls having a cover of ionomer resin of ethylene-(meth)acryl acid copolymer.

However, the cover of the blend of soft and hard ionomers is soft, which helps to increase spin rate for ion shot, while it increases friction between a club face and the cover and in particular when a two-piece solid golf ball or any other similar golf ball having a hard core member is hit with an iron club the grooves of the iron club abrade the cover surface and the ball would thus have a rough surface. This ionomer cover has a low level of hardness and the cover itself has small impact resilience resulting in the exact ball having small impact resilience.

Accordingly GB 2264302 proposes using a metallic salt of ethylene-unsaturated carboxylic acid-unsaturated carboxylate terpolymer having at least two types of low bending moduli to form a cover of a golf ball to reduce abrasion of the cover of the golf ball hit with an iron club. However, when the ball with the cover thus produced is hit with an iron club it exhibits insufficient abrasion resistance and also reduces in impact resilience.

Furthermore, Japanese Patent Laying-open No. 10-179802 proposes a golf ball having a cover with a base material of resin containing two components, ionomer resin and an epoxy group containing, stylene-butadiene-stylene block copolymer or an epoxy group containing, stylene-isoprene-stylene block copolymer, heated and mixed together, as main components, the cover being of a composite providing a flexural rigidity of 50 to 300 MPa, with a Shore-D hardness of 40 to 60.

Furthermore, GB 2311530 proposes a golf ball having a cover with a base resin containing three components, ionomer resin, an acid-modified, thermoplastic elastomer or a thermoplastic elastomer having a terminal with OH group added thereto, and an epoxy group containing, stylene-butadiene-stylene block copolymer or an epoxy group containing, stylene-isoprene-stylene block copolymer, heated and mixed together, as main components, the cover being of a composite providing a flexural rigidity of 50 to 300 MPa, with a Shore D hardness of 40 to 60.

These inventions do improve hit feel, spin characteristics (controllability) and cut resistance, although they do not provide sufficient ball flight distances

SUMMARY OF THE INVENTION

The present invention provides a golf ball providing superior hit feel, large ball flight distances, superior spin characteristics (controllability), and superior abrasion resistance for the golf ball hit with an iron club.

The present golf ball includes a center core, an intermediate layer and a cover, wherein:

- the center core has a diameter of 25 to 40 mm, and a surface hardness (B) and a center hardness (A), the surface hardness (B) being at least 15 greater than the center hardness (A), as measured in Shore D hardness;
- the intermediate layer has a surface hardness (C) 20 to 50 greater than the center hardness (A) of the center core, as measured in Shore D hardness;
- the cover has a hardness (D) of 40 to 60, as measured in Shore D hardness; and
- the surface hardness (C) of the intermediate layer is 5 to 25 greater than the hardness (D) of the cover, as measured in Shore D hardness. Preferably the center core and the intermediate layer are formed of a rubber composite containing cis-1, 4 polybutadiene rubber as a main component.

Furthermore in the present invention desirably a cover composite contains a polymer component containing 10 to 80 parts by weight of ethylene-(meth)acrylic acid copolymer-type ionomer resin (a component A), 0 to 60 parts by weight of ethylene-(meth)acrylic acid-(meth)acrylic ester terpolymer-type ionomer resin (a component B), and 5 to 60 parts by weight of a styrene block containing, thermoplastic elastomer (a component C).

Preferably the styrene block containing, thermoplastic elastomer (the component C) is a polymer alloy of a styrene-butadiene-styrene block copolymer (SBS), a styrene-isoprene-styrene block copolymer (SIS), a styrene-isoprene-butadiene-styrene block copolymer (SIBS) or a hydrogenation thereof and olefin. In the present invention desirably the intermediate layer is greater in specific gravity than the center core.

The foregoing and other objects, features, aspects and advantages of the present invention will become more apparent from the following detailed description of the present invention when taken in conjunction with the accompanying drawings.

BRIEF DESCRIPTION OF DRAWING

The FIGURE illustrates a golf ball of the present invention which includes a center core 1, an intermediate layer 2 and a cover 3.

DESCRIPTION OF THE PREFERRED EMBODIMENTS

The present invention provides a golf ball having a center core with a diameter of 25 to 40 mm, preferably 27 to 38 mm, more preferably 30 to 38 mm. If the golf ball has a diameter less than 25 mm it has an increased spin rate at impact and thus tends to fly upward and cannot provide large ball flight distances. In contrast if the golf ball has a diameter of no less than 40 mm it would have an intermediate layer or a cover reduced in thickness and their respective effects would no longer be expected.

Furthermore the center core has a surface hardness (B) and center hardness (A) with a difference, (B) minus (A), of a Shore D hardness of no less than 15, preferably no less than 17, more preferably no less than 19. A difference in hardness less than 15 is less effective in reducing a spin rate at impact and it also provides a hard and hence bad hit feel at impact. Too large a difference in hardness results in significant deformation at impact and thus impairs durability. Thus a difference of no more than 40 in Shore D hardness is preferable and that of no more than 35 in Shore D hardness is particularly preferable.

Herein the center core preferably has center hardness (A) of 20 to 45, more preferably 25 to 42, and still more preferably 30 to 40 in Shore D hardness. If the center core has center hardness (A) of less than 20 in Shore D hardness it would be too soft and thus provides a small coefficients of restitution and the golf ball is accordingly required to have an intermediate layer increased in hardness to provide the golf ball with appropriate hardness. This impairs durability. If the center core has center hardness (A) exceeding 45 in Shore D hardness it would provide an increased spin rate at impact and thus provide not only an insufficient ball flight distance but also a hard feel.

The center core preferably has surface hardness (B) of 50 to 70, more preferably 52 to 68, still more preferably 55 to 65 in Shore D hardness. If the center core has a surface hardness of less than 50 then it would be too soft and provide a small coefficient of restitution. If it has a surface hardness exceeding 70 it provides hard feel.

The intermediate layer's surface hardness (C) and the center core's center hardness (A) have a difference, (C) minus (A), of 20 to 50, preferably 22 to 45, more preferably 25 to 40 in Shore D hardness. A difference in hardness less than 20 results in an increased spin rate at impact and thus tends to provide an upward ball trajectory and hence an insufficient ball flight distance. A hardness difference exceeding 50 would result in the intermediate layer increased in hardness and thus provide not only hard feel but also poor abrasion resistance and impaired durability.

The intermediate layer has surface hardness (C) of 45 to 70, preferably 47 to 68, more preferably 50 to 65 in Shore D hardness. If the intermediate layer has surface hardness (C) of less than 45 the center core would be required to be hard to provide the ball with optimal hardness. This hardly provides a difference in hardness from the center of the center core and provides an increased spin rate at impact and an insufficient ball fight distance. A hardness exceeding 70 results not only in hard feel but inferior abrasion resistance.

In the present invention the intermediate layer has a thickness of 0.5 to 8.0 mm, preferably 1.0 to 7.0 mm, more preferably 1.0 to 5.0 mm. A thickness less than 0.5 mm would result in the intermediate layer having a level of hardness no longer effective and thus cannot reduce a spin rate at impact, and a thickness exceeding 8.0 mm provides a hard and hence bad feel as the intermediate layer is formed of a relatively hard material.

In the present invention the intermediate layer can be larger in specific gravity than the center core to allow the golf ball to provide an increased moment of inertia and in flight have its revolution maintained to provide an extended ball flight distance. Herein the intermediate layer and the center core have a difference in specific gravity of 0.03 to 0.20, 0.04 to 0.15 in particular. A difference in specific gravity exceeding 0.20 results in the intermediate layer associated with a reduced coefficient of restitution.

Herein the intermediate layer has a specific gravity of 1.10 to 1.30, preferably 1.12 to 1.25, more preferably 1.15 to 120. If the intermediate layer has a specific gravity less than 1.10 it is required to have a specific gravity accordingly increased to provide a difference in specific gravity from the center core and as a result its coefficient of restitution is reduced. The center core has a specific gravity of 1.00 to 1.20, preferably 1.05 to 1.15, more preferably 1.07 to 1.13. If the center core has a specific gravity less than 1.00 the intermediate layer is required to have a specific gravity increased to provide the golf ball with an appropriate weight and as a result the intermediate layer would have a large amount of filler added thereto and the center core's coefficient of restitution would thus be reduced.

The center core and the intermediate layer are formed of a composite containing a rubber component as a main component. The rubber component can for example be natural rubber, styrene-butadiene rubber, isoprene rubber or the like, although particularly preferably it is cis-1,4-polybutadiene rubber. Then for 100 parts by weight of the rubber component is blended a covulcanizer of 10 to 60 parts by weight in total of acrylic acid, methacrylic acid or any other similar ($\alpha$, $\beta$-unsaturated carboxylic acid of a carbon number of 3 to 8, a sodium salt, zinc salt or magnesium salt thereof or any other similar, monovalent or divalent metallic salt, and trimethylol propane trimethacrylate or any other similar, one or more types of functional monomer. Furthermore, the center core and intermediate layer composite may be blended with 0.5 to 5 parts by weight of organic peroxide or any other similar crosslink initiator, 5 to 30 parts by weight of zinc oxide, barium sulfate or any other similar additive, 5 to 30 parts by weight of a filler, and 0.5 to 5 parts by weight of organic sulfur compound, antioxidant and the like.

The present golf ball has a cover having a Shore D hardness (D) of 40 to 60, preferably 42 to 58, more preferably 45 to 55. A Shore D hardness less than 40 would provide an increased spin rate at impact and thus tend to provide an upward ball trajectory and hence an insufficient ball fight distance. A Shore D hardness exceeding 60 would result in an approach shot with a short iron club having a small spin rate and thus provide inferior controllability.

Furthermore the cover has a thickness of 0.5 to 2.0 mm, preferably 0.8 to 1.8 mm, more preferably 1.0 to 1.5 mm. A thickness less than 0.5 mm would not provide the effect that a soft cover has, and the ball would thus have a low spin rate for an approach shot with a short iron club and be inferior in controllability. A thickness exceeding 2.0 mm results in a golf ball associated with a reduced coefficient of restitution and an increased spin rate at impact and thus tends to provide an upward ball trajectory and hence an insufficient ball flight distance.

The present golf ball cover composite contains 10 to 80 parts by weight of ethylene-acrylic acid copolymer ionomer resin and/or ethylene-methacrylic acid copolymer ionomer resin, referred to as a component A, blended therewith. The ratio in composition of the copolymer of ethylene and acrylic or methacrylic acid is preferably 70 to 95% by weight of ethylene and 5 to 30% by weight of acrylic or methacrylic acid. Note that the above ionomer is partially neutralized by a metallic salt and crosslinked by a metal ion, such as sodium ion, lithium ion, zinc ion, magnesium ion, potassium ion or the like.

Preferably, the ionomer resin with the ethylene-acrylic or methacrylic acid copolymer having therein a carboxyl group at least partially neutralized and crosslinked with a metal ion, has a Shore D hardness of 40 to 60 and a flexural rigidity of 100 to 500 MPa.

The above ionomer exemplified under trade name includes Hi-milan 1555 (Na), Hi-milan 1557 (Zn), Hi-milan 1605 (Na), Hi-milan 1706 (Zn), Hi-milan 1707 (Na), Hi-milan AM 7318 (Na), Hi-milan AM 7315 (Zn), Hi-milan AM 7317 (Zn), Hi-milan AM 7311 (Mg), Hi-milan MK 7320 (K), and the like commercially available from Mitsui-DuPont Polychemical Co., Ltd.

Furthermore, Dupont Co., Ltd. commercially provides the ionomer resin under the trade names of Surlyn 8945 (Na), Surlyn 8940 (Na), Surlyn 9910 (Zn), Surlyn 9945 (Zn), Surlyn 7930 (Li), Surlyn 7940 (Li), and the like. Furthermore, Exxon Chemical Japan Ltd. commercially provides the ionomer resin under the trade names of Iotek 7010 (Zn), Iotek 8000 (Na), Iotek 7030 (Zn), Iotek 8030 (Na), and the like.

Note that the above trade names of the ionomer resin are followed by parenthesized symbols Na, Zn, K, Li, Mg and the like, which indicate metal types of these neutralizer metal ions. Furthermore in the present invention the cover may be formed with a base resin of ionomer resin corresponding to a mixture of two or more of the above exemplified ionomer resins or a mixture of one or more of the above exemplified, monovalent metal iron neutralized, ionomer resins and one or more of the above exemplified, divalent metal iron neutralized, ionomer resins.

Then as a component B of the cover composite is blended 0 to 60 parts by weight of ionomer resin of a terpolymer of ethylene, acrylic or methacrylic acid, and acrylic or methacrylic ester. Preferably, the ratio in composition of the three components of the copolymer is 70 to 85% by weight of ethylene, 5 to 20% by weight of (meth)acrylic acid, and 10 to 25% by weight of (meth)acrylic ester. Note that the (meth)acrylic ester is ester for example of methyl, ethyl, propyl, n-butyl or isobutyl. The above terpolymer ionomer resin is for example Hi-milan 1856 (Na), Hi-milan 1855 (Zn), Hi-milan AM 7316 (Zn), and the like commercially available from Mitsui-DuPont Polychemical Co., Ltd.

Furthermore, Dupont Co., Ltd. commercially provides Surlyn 8320 (Na), Surlyn 9320 (Zn), Surlyn 6320 (Mg), and the like. Furthermore, Exxon Chemical Japan Ltd. commercially provides Iotek 7510 (Zn), Iotek 7520 (Zn), and the like.

The above terpolymer ionomer resin preferably has a Shore D hardness of 30 to 55 and a flexural rigidity of 10 to 100 MPa. Blending component B effectively promotes the compatibility of components A and C.

The present cover's base resin of the ionomer of components A and B is then blended with a component C, 5 to 60 parts by weight of one or more types of thermoplastic elastomer having a styrene block, preferably a block copolymer of a conjugated diene compound for example of a styrene block and a butadiene block or an isoprene block, wherein the conjugated diene compound can be one or more selected for example from butadiene, isoprene, 1,3-pentadiene, 2,3-dimethyl-1,3-butadiene and the like, preferably butadiene, isoprene and a combination thereof.

The thermoplastic elastomer having a styrene block for example includes a styrene-butadiene-styrene copolymer (SBS), the SBS having butadiene with a double bond hydrogenated, or a styrene-ethylene-butylene-styrene block copolymer (SEBS), a styrene-isoprene-styrene block copolymer (SIS), the SIS having isoprene with a double bond hydrogenated, or a styrene-ethylene-propylene-styrene block copolymer (SEPS), a styrene-isoprene-butadiene-styrene block copolymer (SIBS), the SIBS having butadiene or isoprene with a double bond hydrogenated, or a styrene-ethylene-ethylene-propylene-styrene block copolymer (SEEPS), and these copolymers modified.

Note that the above SBS, SEBS, SIS, SEPS, SIBS and SEEPS preferably contain 10 to 50% by weight, particularly preferably 15 to 45% by weight thereof. If the copolymers contain less than 10% by weight of styrene the thermoplastic elastomer would be too soft and cut resistance would tend to be small. If they contain more than 50% by weight of styrene, blending with ionomer resin as component A would result in insufficient softness, and hit feel and spin characteristics improve insufficiently.

In the present invention the SBS, SEBS, SIS and SEPS block copolymers may partially contain an epoxy group.

For example, the SBS containing an epoxy group is a block copolymer with both terminals having polystyrene and an intermediate layer corresponding to polybutadiene containing an epoxy group, and the polybutadiene may by associated with a double bond partially or entirely hydrogenated. Furthermore, the SIS containing an epoxy group is a block copolymer with both terminals having polystyrene and an intermediate layer corresponding to polyisoprene containing an epoxy group, and the polyisoprene may by associated with a double bond partially or entirely hydrogenated.

The epoxydized SBS or SIS block copolymer preferably contains 0.05 to 10% by weight of an epoxy group, more preferably 0.2 to 5% by weight thereof. If it contains less than 0.05% by weight of the epoxy group the epoxy group and a free radical carboxyl group of the ionomer resin react in a reduced amount and in the ionomer resin the copolymer would have a reduced degree of dispersion and durability might be impaired. If the copolymer contains more than 10% by weight of an epoxy group the epoxy group and a free radical carboxyl group of the ionomer resin react excessively. This may impair fluidity and make it difficult to mold the golf ball.

The epoxydized SBS or SIS block copolymer is commercially available for example from Daicel Chemical Industries, Ltd. under the trade name of Epofriend.

Furthermore, the block copolymer having the SEBS or SEPS with a hydroxyl group added to a terminal thereof, is commercially available for example from Kuraray Co., Ltd. under the trade name of Septon HG-252.

The present inventors have found that when the styrene block containing, thermoplastic elastomer (component C) is a polymer alloy of the SBS, an hydrogenated SBS, the SIS, an hydrogenated SIS, the SIBS or an hydrogenated SIBS and olefin the resultant golf ball has a superior physical covering property and superior performance and in particular that it maintains a coefficient of restitution of a high level. This is probably attributed to for example the component of olefin contained in the polymer alloy contributes to the compatibility of the cover composite. Note that particularly preferably, a hydrogenated SBS block copolymer (SEBS) is used as a base polymer and molecularly blended with a different polymer to provide a so-called a polymer alloy. Note that the different polymer is preferably a polyolefin obtained by copolymerizing an olefin of a carbon number of two to ten.

In the present invention the styrene block containing, thermoplastic elastomer has a Shore A hardness of no more than 95, preferably no more than 80.

Herein the cover composite has a polymer component containing 10 to 80 parts by weight of component A, 0 to 60 parts by weight of component B, and 5 to 60 parts by weight of component C mixed together. When components A, B and C are ranged as above and thus mixed together their satisfactory compatibility allows molecular-bending to form a so-called polymer alloy to provide hardness, strength, impact resilience and other similar physical properties that cannot be obtained from conventional, simple blend types. Consequently, the superior rigidity and impact resilience attributed to component A can be maintained while the cover can be softened, and hit feel, spin performance (controllability) and, furthermore, abrasion resistance can be improved. In the present invention, component B can be mixed in a certain range to promote the compatibility of components A and C and the composite can be enhanced in strength and impact resilience while the cover can be softened to further improve spin performance and hit feel.

In the present cover composite the aforementioned polymer component and in addition another polymer component can be mixed. The additional polymer is mixed such that no more than 10 parts by weight thereof is mixed for 100 parts by weight of the entire polymer component. Herein the additional polymer can be one of polyolefin-type elastomer, polyurethane-type elastomer, polyester-type elastomer and the like or a mixture of two or more of the elastomers. The polyolefin-type elastomer specifically exemplified under trade name includes Milastomer M4800NW of Mitsui Petrochemical Industries, Co., Ltd., Sumitomo TPE 3682, 9455 of Sumitomo Chemical Co., Ltd., and the like. The polyurethane-type elastomer specifically exemplified under trade name includes Kuramilon 9195, 9180 of Kuraray Co., Ltd., Elastollan ET 880, ET 890 of Takeda Badishe Urethane Industries Ltd., and the like. The polyester-type elastomer specifically exemplified under trade name includes Hytrel 4047, 4767, 5557 of DuPont-Toray Co., Ltd. and the like.

In the present invention the cover composite can have various types of additive added thereto, as required, such as pigment, specific-gravity adjuster, dispersing agent, antioxidant, UV absorbent, photostabilizer, and the like.

The present golf ball cover after it is molded has a Shore D hardness of 40 to 60, preferably 42 to 55, more preferably 45 to 55. If the cover composite has a Shore D hardness less than 40 it would be too soft and thus provide inferior hit feel and small abrasion resistance. If it has a Shore D hardness exceeding 60 it cannot provide an appropriate back spin rate and thus provides poor controllability and bad hit feel.

The present golf ball provides a moment of inertia of no more than 83.0 g $cm^2$, preferably 82.0 g $cm^2$, more preferably 81.9 g $cm^2$. If it provides a moment of inertia exceeding 83.0 g $cm^2$ a large amount of filler must be blended to increase the cover's specific gravity and thus reduces the cover's coefficient of restitution. On the other hand, a moment of inertia having too small a value accelerates the damping of the spin at impact and the ball thus tends to have a dropping trajectory and hardly provides sufficient ball fight distances. Thus a moment of inertia of no less than 79.0 g $cm^2$, preferably no less than 80.0 g $cm^2$, more preferably no less than 80.5 g $cm^2$.

EXAMPLES

The present invention will now be described specifically in accordance with examples thereof.

Examples 1–6 and Comparative Examples 1–3

The following steps (1) to (4) were followed to produce golf balls of the examples and comparative examples.

(1) Production of Center Core

A rubber composite having the Table 1 composition was mixed and kneaded and thus prepared. The medium was introduced into a die and vulcanized by a vulcanizing press and thus molded to obtain a spherical center core of a predetermined diameter. It was vulcanized at 165° C. for 20 minutes. The obtained center core had a diameter, a weight, a center hardness, a surface hardness, and a specific gravity, as presented in Table 1.

(2) Production of Core Covered with Intermediate Layer

A rubber composite blended as in Table 1 was mixed and kneaded and then used to provide an intermediate layer to concentrically cover the center core prepared at step (1). The medium was introduced into a die and vulcanized by a vulcanizing press and thus molded to obtain a spherical, dual-layer core (the center core and the intermediate layer) having a predetermined diameter. It was vulcanized at 165° C. for 20 minutes. The obtained dual-layer core had an intermediate layer had a thickness, a specific gravity and a surface hardness, as presented in Table 1.

TABLE 1

| | blend | A | B | C | D | E | F |
|---|---|---|---|---|---|---|---|
| center core | (blend) | | | | | | |
| | BR11 ·X·1 | 100 | 100 | 100 | 100 | 100 | 100 |
| | zinc acrylate | 28 | 29 | 34 | 20 | 29 | 29 |
| | zinc oxide | 5 | 5 | 5 | 5 | 5 | 5 |
| | barium sulfate | 6 | 11 | 14.5 | — | — | 31 |
| | dicumyl peroxide | 1 | 1 | 1 | 1 | 1 | 1 |
| | diphenyldisulfide | 0.5 | 0.5 | 0.5 | 0.5 | 0.5 | 0.5 |
| | weight (g) | 12.4 | 19.1 | 30.2 | 7.4 | 18 | 20.9 |
| | diameter (mm) | 28 | 32 | 37 | 24 | 32 | 32 |

TABLE 1-continued

| | blend | A | B | C | D | E | F |
|---|---|---|---|---|---|---|---|
| | center hardness | 33 | 37 | 41 | 31 | 37 | 38 |
| | (Shore D) (A) | 52 | 55 | 60 | 46 | 55 | 56 |
| | surface hardness (Shore D) (B) | | | | | | |
| | specific gravity | 1.08 | 1.11 | 1.14 | 1.02 | 1.05 | 1.22 |
| intermediate layer | (blend) | | | | | | |
| | BR11 ※1 | 100 | 100 | 100 | 100 | 100 | 100 |
| | zinc acrylate | 33 | 35.5 | 35.5 | 33 | 35.5 | 35.5 |
| | zinc oxide | 5 | 5 | 5 | 5 | 5 | 5 |
| | barium sulfate | 21.5 | 20.5 | 20.5 | 21.5 | 11.5 | 4 |
| | dicumyl peroxide | 0.5 | 0.5 | 0.5 | 0.5 | 0.5 | 0.5 |
| | thickness (mm) | 6.0 | 4.0 | 1.5 | 8.0 | 4.0 | 4.0 |
| | specific gravity | 1.18 | 1.18 | 1.18 | 1.18 | 1.13 | 1.09 |
| | surface hardness (Shore D) (B) | 59 | 61 | 61 | 59 | 61 | 60 |
| core | weight (g) | 38.7 | 38.7 | 38.7 | 38.7 | 36.8 | 38.7 |
| | diameter (mm) | 40.0 | 40.0 | 40.0 | 40.0 | 40.0 | 40.0 |
| | surface hardness (Shore D) (B) | 59 | 61 | 61 | 59 | 61 | 60 |

※1. product name: high cis polybutadiene rubber (cis-1, 4 constituent: 96%)

(3) Preparation of Cover Composite

As presented in the Table 2 composition, materials to be blended were mixed by a dual-axis kneading extruder to prepare a composite for the cover in pellets. In Table 2, the amount of each material blended is represented in parts by weight for 100 parts by weight of the polymer component and the Table 2 materials that are represented by product name are described below the table in detail.

In extruding the medium, a screw diameter of 45 mm, a screw revolution rate of 200 rpm and a screw L/D of 35 were applied. The blend was heated to 160 to 260° C., positioned at a die of the extruder.

TABLE 2

| blend | a | b | c | d | e | f | g |
|---|---|---|---|---|---|---|---|
| Hi-milan 1605 ※2 | 20 | | | | 40 | | 50 |
| Hi-milan 1706 ※3 | 20 | | | | 10 | | 50 |
| Hi-milan 1555 ※4 | | 35 | 40 | 45 | | | |
| Hi-milan 1855 ※5 | 10 | 35 | 40 | 45 | 35 | | |
| Rabalon SJ7400N ※6 | | | | | | | |
| Rabalon SR04 ※7 | 50 | 30 | 20 | 10 | | | |
| Dynaron 6200P ※8 | | | | | 15 | | |
| Pandex T-7890 ※9 | | | | | | 100 | |
| titanium dioxide | 3 | 3 | 3 | 3 | 3 | 3 | 3 |
| cover hardness (Shore D) | 31 | 42 | 47 | 52 | 52 | 41 | 64 |

※2. the product name of a sodium ion neutralized ethylene-methacrylic acid copolymer-type ionomer resin of Mitsui-Dupont Polychemical Co., Ltd.

※3. the product name of a zinc ion neutralized ethylene-methacrylic acid copolymer-type ionomer resin of Mistui-Dupont Polychemical Co., Ltd.

※4. the product name of a sodium ion neutralized ethylene-methacrylic acid copolymer-type ionomer resin of Mitsui-Dupont Polychemical Co., Ltd.

TABLE 2-continued

| blend | a | b | c | d | e | f | g |
|---|---|---|---|---|---|---|---|

※5. the product name of a zinc ion neutralized ethylene-methacrylic acid-isobutyl acrylate terpolymer-type ionomer resin of Mitsui-Dupont Polychemical Co., Ltd.

※6. the product name of a styrene-ethylene-butylene-styrene block copolymer (SEBS)-based, thermoplastic elastomer of Mitsui Petrochemical Industries Ltd. Shore A hardness: 75

※7. the product name of a styrene-ethylene-butylene-styrene block copolymer (SEBS)-based, thermoplastic elastomer of Mitsui Petrochemical Industries Ltd. Shore A hardness: 40

※8. the product name of hydrogenated polybutadiene (CEBC) of JSR Corporation. Shore A hardness: 66. Note that in the CEBC, the letter C means a crystalline polyethylene block and the CEBC means polyethylene crystal-ethylene-butylene-polyethylene crystal.

※9. the product name of a thermoplastic polyurethane elastomer using hexamethylenediisocyanate (HDI) of Dainippon Ink and Chemicals, Inc.

(4) Production of Golf Ball

The cover composite obtained at step (3) was injection-molded outside the dual-layer core obtained at step (2) and the cover was controlled in thickness, as shown in Table 3, and the golf ball was thus molded. Then on the cover surface a clear paint was applied to provide golf balls of examples 1–6 and comparative examples 1–3 having an outer diameter of 42.8 mm and a weight of 45.3 g. A blending for a cover that was used in producing the golf ball is shown in Table 3 together with a physical property of the ball, as measured in a method described hereinafter.

TABLE 3

Golf Ball Characteristics Estimation

| | | Examples | | | | | | Comparative Examples | | |
|---|---|---|---|---|---|---|---|---|---|---|
| | | 1 | 2 | 3 | 4 | 5 | 6 | 1 | 2 | 3 |
| Core (Center | Blending for Center Core & Intermediate Layer | A | B | C | B | E | F | D | B | B |

TABLE 3-continued

| | Golf Ball Characteristics Estimation | Examples | | | | | | Comparative Examples | | |
|---|---|---|---|---|---|---|---|---|---|---|
| | | 1 | 2 | 3 | 4 | 5 | 6 | 1 | 2 | 3 |
| Core + | Center Core | | | | | | | | | |
| Intermediate Layer) | Diameter (mm) | 28.0 | 32.0 | 37.0 | 32.0 | 32.0 | 32.0 | 24.0 | 32.0 | 32.0 |
| | Weight (g) | 12.4 | 19.1 | 30.2 | 19.1 | 18 | 20.9 | 7.4 | 19.1 | 19.1 |
| | Specific Gravity | 1.08 | 1.11 | 1.14 | 1.11 | 1.05 | 1.22 | 1.02 | 1.11 | 1.11 |
| | Center Hardness (Shore D) (A) | 33 | 37 | 41 | 37 | 37 | 38 | 31 | 37 | 37 |
| | Surface Hardness (Shore D) (B) | 52 | 55 | 60 | 55 | 55 | 56 | 46 | 55 | 55 |
| | (B)-(A) | 19 | 18 | 19 | 18 | 18 | 18 | 15 | 18 | 18 |
| | Intermediate Layer | | | | | | | | | |
| | Thickness (mm) | 6.0 | 4.0 | 1.5 | 4.0 | 4.0 | 4.0 | 8.0 | 4.0 | 4.0 |
| | Surface Hardness (Shore D) (C) | 59 | 61 | 61 | 61 | 61 | 60 | 59 | 61 | 61 |
| | Specific Gravity | 1.18 | 1.18 | 1.18 | 1.18 | 1.13 | 1.09 | 1.18 | 1.18 | 1.18 |
| | Core (Center Core + Intermediate Layer) | | | | | | | | | |
| | Diameter (mm) | 40.0 | 40.0 | 40.0 | 40.0 | 40.0 | 40.0 | 40.0 | 40.0 | 40.0 |
| | Weight (g) | 38.7 | 38.7 | 38.7 | 38.7 | 36.8 | 38.7 | 38.7 | 38.7 | 38.7 |
| | Deformability | 3.05 | 2.95 | 2.85 | 2.95 | 2.95 | 3.00 | 2.85 | 2.95 | 2.95 |
| | (C)-(A) | 26 | 24 | 20 | 24 | 24 | 22 | 28 | 24 | 24 |
| Cover | Blending | d | c | b | e | f | c | c | a | g |
| | Thickness (mm) | 1.4 | 1.4 | 1.4 | 1.4 | 1.4 | 1.4 | 1.4 | 1.4 | 1.4 |
| | Hardness (Shore D) (D) | 52 | 47 | 42 | 52 | 41 | 47 | 47 | 31 | 64 |
| | (C)-(D) | 7 | 14 | 19 | 9 | 20 | 13 | 12 | 30 | −3 |
| Characteristics | Flight Performance (1) | | | | | | | | | |
| | W#1 50 m/s | | | | | | | | | |
| | Initial Ball Velocity (m/s) | 72.2 | 72.1 | 72.0 | 71.8 | 71.2 | 71.8 | 72.1 | 71.6 | 72.4 |
| | Spin Rate (rpm) | 2450 | 2410 | 2360 | 2380 | 2480 | 2520 | 2620 | 2590 | 2310 |
| | Overall Flight Distance (m) | 265.0 | 266.2 | 265.5 | 260.8 | 255.5 | 256.0 | 253.5 | 254.3 | 267.5 |
| | Flight Performance (2) | | | | | | | | | |
| | #SW 21 m/s | | | | | | | | | |
| | Spin Rate (rpm) | 6850 | 6880 | 6900 | 6800 | 6980 | 6910 | 6950 | 7080 | 4750 |
| | Hit Feel | ○ | ○ | ○ | ○ | ○ | ○ | X | ○ | X |
| | Abrasion Resistance | ○ | ○ | ○ | X | ○ | ○ | ○ | Δ | ○ |
| | Moment of Inertia (gcmm$^2$) | 81.9 | 81.6 | 81.3 | 81.6 | 84.1 | 78.8 | 82.0 | 81.5 | 81.7 |

(5) Estimation of Performance of Golf Ball Shore D Hardness

A spring Shore D hardness meter as defined by ASTM-D2240 was used.

The hardness measured at an outer surface of the center core and that measured at an outer surface of the intermediate layer were adopted as surface hardness. Furthermore, the center core was bisected and the hardness measured in the cross section at the center was adopted as center hardness.

The cover's hardness was measured, as follows: a 2-mm-thick, thermally pressed sheet prepared from each cover composite was stored at 23° C. for two weeks and more than two such sheets were successively posed and hardness was thus measured.

Flight Performance (1)

A swing robot of Golf Laboratory Co., Ltd. with a metal-head wood No. 1 club (XXIO manufactured by Sumitomo Rubber Industries Ltd.: W#1, a loft angle of eight degrees, X shaft) attached thereto was used with a head speed of 50 m/sec set to hit each golf ball and the ball's speed immediately after it was hit, back spin rate (spin rate) and total fight distance corresponding to the ball's flight distance to its stop point were measured. Each ball was measured twelve times and the twelve measurements were averaged.

Flight Performance (2)

A swing robot of Golf Laboratory Co., Ltd. with a sand wedge (DP-601, SW manufactured by Sumitomo Rubber Industries Ltd.) attached thereto was used with a head speed of 21 m/sec set to hit each golf ball and the ball's back spin rate (spin rate) was measured. Each ball was measured twelve times and the twelve measurements were averaged.

Hit Feel 10 golfers using a metal-head W#1 driver hit golf balls to estimate hit impact, as follows:

circle: small hit impact and good hit feel cross: significant hit impact and bad hit feel and for each ball the estimation supported by the largest number of the golfers was adopted as that for the ball.

Abrasion Resistance

A swing robot of Golf Laboratory Co., Ltd. with a pitching wedge (Tour forged, PW manufactured by Sumitomo Rubber Industries Ltd.) attached thereto was used with a head speed of 36 m/sec set to hit each golf ball at two locations, each once, and the two hit locations were observed and estimated, as follows:

a circle indicates that although the ball surface is slightly damaged, it is substantially tolerable;

a triangle indicates that the ball surface is abraded and slightly fuzzy; and a cross indicates that the ball surface is rather abraded and noticeably fuzzy.

Moment of Inertia

Inertia Dynamics model MOI-005-002 of Inertia Dynamics Inc. was used for measurement.

Core Deformability

A core receiving an initial load of 10 kgf through a final load of 130 kgf was continuously measured for deformability in millimeters.

(6) Result of Estimation of Golf Ball

It can be understood from Table 3 that the golf balls of Examples 1–6 are generally superior to those of comparative examples 1–3 in flight distance, spin performance, hit feel and abrasion resistance. The golf ball of example 5 provides a slightly shorter flight distance as its cover is formed of urethane resin. The golf ball of example 6 provides a small moment of inertia and a slightly shorter flight distance as its intermediate layer is smaller in specific gravity than its center core.

The golf ball of comparative example 1 has a center core having a small diameter and a thick intermediate layer. As such when it is hit with a driver it has a high spin rate and thus provides a short flight distance and a bad hit feel. The golf ball of comparative example 2 has too soft a cover and when it is hit with a driver it has a high spin rate and thus provides a short flight distance. The golf ball of comparative example 3 has too hard a cover and thus provides a long flight distance, although for a sand wedge it has a low spin rate and also provides a hard and hence bad hit feel.

As has been described above, the present invention can provide a golf ball including a center core, an intermediate layer and a cover each having a surface hardness and the like adjusted to fall within a certain range to allow the golf ball to be generally superior in flight distance, spin characteristics, hit feel and abrasion resistance. Furthermore, for a cover composite's polymer component, an ethylene-(meth)acrylic acid copolymer ionomer resin (component A) can be blended with a styrene block containing, thermoplastic elastomer (component C) within a particular range, and, as required, further mixed with an acrylic acid-(meth)acrylic acid-(meth)acrylic ester terpolymer ionomer resin (component B) and these components allows molecular blending to provide superior basic covering characteristics different than conventional blend types The cover can be used to provide a golf ball generally further enhanced in hit feel, flight distance, spin characteristics and abrasion resistance.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf ball comprising a center core, an intermediate layer and a cover, wherein:

said center core has a diameter of 25 to 40 mm, and a surface hardness (B) and a center hardness (A), said surface hardness (B) being at least 15 greater than said center hardness (A), as measured in Shore D hardness;

said intermediate layer has a surface hardness (C) 20 to 50 greater than said center hardness (A) of said center core, as measured in Shore D hardness;

said cover has a hardness (D) of 40 to 60, as measured in Shore D hardness; and said surface hardness (C) of said intermediate layer is 5 to 25 greater than said hardness (D) of said cover, as measured in Shore D hardness.

2. The golf ball of claim 1, wherein said center core and said intermediate layer are formed of a rubber composite containing cis-1, 4 polybutadiene rubber as a main component.

3. The golf ball of claim 1, wherein a cover composite contains a polymer component containing 10 to 80 parts by weight of ethylene-(meth)acrylic acid copolymer-type ionomer resin (a component A), 0 to 60 parts by weight of ethylene-(meth)acrylic acid-(meth)acrylic ester terpolymer-type ionomer resin (a component B), and 5 to 60 parts by weight of a styrene block containing, thermoplastic elastomer (a component C).

4. The golf ball of claim 3, wherein said styrene block containing, thermoplastic elastomer (said component C) is a polymer alloy of a styrene-butadiene-styrene block copolymer (SBS), a styrene-isoprene-styrene block copolymer (SIS), a styrene-isoprene-butadiene-styrene block copolymer (SIBS) or a hydrogenation thereof and olefin.

5. The golf ball of claim 1, wherein said intermediate layer is greater in specific gravity than said center core.

6. A golf ball according to claim 1, wherein the center core has a diameter of 30 to 38 mm.

7. A golf ball according to claim 1, wherein the surface hardness (B) of the center core is at least 17 greater than said center hardness (A), as measured in Shore D hardness.

8. A golf ball according to claim 1, wherein the surface hardness (B) of the center core is at least 19 greater than said center hardness (A), as measured in Shore D hardness.

9. A golf ball according to claim 1, wherein the surface hardness (B) of the center core is no more than 35 greater than said center hardness (A), as measured in Shore D hardness.

10. A golf ball according to claim 1, wherein the center core has a center hardness (A) of 20 to 45, as measured in Shore D hardness.

11. A golf ball according to claim 1, wherein the center core has a center hardness (A) of 30 to 40, as measured in Shore D hardness.

12. A golf ball according to claim 1, wherein the center core has a surface hardness (B) of 50 to 70, as measured in Shore D hardness.

13. A golf ball according to claim 1, wherein the center core has a surface hardness (B) of 55 to 65, as measured in Shore D hardness.

14. The golf ball according to claim 1, wherein said intermediate layer has a surface hardness (C) 22 to 45 greater than said center hardness (A) of said center core, as measured in Shore D hardness.

15. The golf ball according to claim 1, wherein said intermediate layer has a surface hardness (C) 25 to 40 greater than said center hardness (A) of said center core, as measured in Shore D hardness.

16. The golf ball according to claim 1, wherein the surface hardness (C) of said intermediate layer is 45 to 70, as measured in Shore D hardness.

17. The golf ball according to claim 1, wherein the surface hardness (C) of said intermediate layer is 50 to 65, as measured in Shore D hardness.

18. The golf ball according to claim 1, wherein the cover has a hardness (D) of 42 to 58, as measured in Shore D hardness.

19. The golf ball according to claim 1, wherein the cover has a hardness (D) of 45 to 55, as measured in Shore D hardness.

20. The golf ball of claim 1, wherein said center core has a center hardness (A) of 30 to 40 in Shore D hardness;

said surface hardness (B) is at least 19 greater than and no more than 35 greater than said center hardness (A), as measured in Shore D hardness;

said intermediate layer has a surface hardness (C) 25 to 40 greater than said center hardness (A) of said center core, as measured in Shore D hardness; and said cover has a hardness (D) of 45 to 55 as measured in Shore D hardness.

* * * * *